United States Patent [19]

Weber et al.

[11] Patent Number: 5,062,978

[45] Date of Patent: Nov. 5, 1991

[54] AQUEOUS LUBRICANT SOLUTIONS BASED ON FATTY ALKYL AMINES

[75] Inventors: Frank Weber, Duisburg; Wolfgang Preibsch, Merzenich, both of Fed. Rep. of Germany

[73] Assignee: Unilever Patent Holdings BV, Rotterdam, Netherlands

[21] Appl. No.: 443,430

[22] Filed: Nov. 29, 1989

[30] Foreign Application Priority Data

Dec. 5, 1988 [EP] European Pat. Off. ..... 88202781.6

[51] Int. Cl.[5] ..... C10M 173/02

[52] U.S. Cl. ..... 252/49.3; 252/50; 252/51.5 R

[58] Field of Search ..... 252/49.3, 50, 51.5 R

[56] References Cited

U.S. PATENT DOCUMENTS

| | | | |
|---|---|---|---|
| 2,990,943 | 7/1961 | Turinsky | 252/49.3 |
| 3,051,655 | 8/1962 | Barker | 252/49.3 |
| 3,372,112 | 3/1968 | Parker | 252/8.5 |
| 3,468,804 | 9/1969 | Perry | 252/143 |
| 3,814,212 | 6/1974 | Latos | 252/50 |
| 3,860,521 | 1/1975 | Aepli et al. | 252/49.3 |
| 4,039,460 | 8/1977 | Koch | 252/49.3 |
| 4,058,472 | 11/1977 | Kablaoui | 252/89 |
| 4,521,321 | 6/1985 | Anderson et al. | 252/49.3 |
| 4,548,726 | 10/1985 | Morris-Sherwood et al. | 252/49.3 |
| 4,549,974 | 10/1985 | Horodysky | 252/33.6 |
| 4,604,220 | 8/1986 | Stanton | 252/33.4 |
| 4,839,067 | 6/1989 | Jansen | 252/49.3 |
| 4,883,606 | 1/1989 | Kuwamoto | 252/49.3 |
| 4,929,375 | 5/1990 | Rossio et al. | 252/49.3 |

FOREIGN PATENT DOCUMENTS

| | | |
|---|---|---|
| 1000438 | 12/1982 | Australia . |
| 0032415 | 7/1981 | European Pat. Off. . |
| 3631953 | 3/1988 | Fed. Rep. of Germany . |
| 2602955 | 8/1988 | France . |
| 74010794 | 10/1970 | Japan . |
| 82205494 | 6/1981 | Japan . |
| 1-096294 | 4/1989 | Japan . |
| 8707638 | 12/1987 | PCT Int'l Appl. . |
| 777258 | 12/1977 | South Africa . |
| 837963 | 10/1983 | South Africa . |
| 1294038 | 10/1972 | United Kingdom . |

OTHER PUBLICATIONS

*The Condensed Chemical Dictionary*, G. G. Hawley (9th Ed., 1977), p. 321.

*Dictionary of Surface Active Agents*, Cosmetics and Toiletries, Dr. G. Carriére, (1978), pp. 47 and 48.

*Primary Examiner*—Prince E. Willis

*Assistant Examiner*—Jerry D. Johnson

*Attorney, Agent, or Firm*—David H. Vickrey; Louis A. Morris

[57] ABSTRACT

The invention relates to an aqueous lubricant solution based in part on a particular group of fatty alkyl amines, which aqueous solution is especially suitable for use as a belt lubricant for the lubrication of conveyor belts for bottles. The aqueous lubricant solutions in accordance with the present invention exhibit excellent clouding behavior and very good gliding action.

13 Claims, No Drawings

AQUEOUS LUBRICANT SOLUTIONS BASED ON FATTY ALKYL AMINES

BACKGROUND OF THE INVENTION

The present invention relates generally to aqueous amine-containing lubricant solutions. More particularly, the present invention relates to such lubricant solutions and their use as a conveyor belt lubricant for the lubrication of conveyor belts for bottles.

Lubricants are employed in applications in which good gliding contact between solid surfaces, for instance glass and metal or metal and metal, must be ensured. Amine-containing synthetic lubricants are, in general, known for a variety of such applications. See, for example, U.S. Pat Nos. 3,372,112, 3,814,212, 4,549,974, GB1294038, EP-A-0032415, W087/07638 and JP-LO-82/205494, all of which are incorporated by reference herein.

Additionally known are amine-containing cleaning solutions for, e.g., milk equipment and silver. See FR-A-2602955 and U.S. Pat. No. 3,468,804, both of which are also incorporated by reference herein.

Lubricants are also frequently used in bottle filling and conveying plants, where they are applied to the conveyor belts to ensure the trouble-free conveyance of bottles on the conveyor belt. When used as such, the lubricants are also referred to as belt lubricants.

In many typical systems, a soap such as a potash-based soft soap is used as the belt lubricant. A problem of such soaps is that they have a tendency to form poorly-soluble precipitates with cations present in hard water, such as calcium, requiring the addition of sequestering agents or the use of soft water.

As a substitute for the soaps, a variety of synthetic belt lubricants including certain amine compounds have been described in the literature. See, for example, DE-OS-3631953 (U.S. Pat. No. 4,839,067), JP-LO-74/010794, JP-LO-89/096294, U.S. Pat. Nos. 4,521,321, 4,604,720, ZA77/7258, ZA83/7963 and AU-A-10004/83, all of which are incorporated by reference herein. These synthetic belt lubricants are generally an improvement over the aforementioned potash-based soaps; however, in some cases they tend to form poorly-soluble precipitates with polyvalent anions present in hard water, such as carbonates and sulphates, which manifests itself in the clouding of the lubricant solution. For that reason the behavior of lubricants in anion-containing water is sometimes called clouding behavior.

Since the precipitates formed can cause breakdowns as a result of deposits in blind zones or clogging of nozzles, they must be removed regularly, mostly once a day, by cleaning the plant. Heavy clouding behavior of a lubricant solution is especially critical in places where the water contains a high proportion of polyvalent anions. In fact, the problem in some places may be so great that soft water is used instead of tap water, or substantially more frequent cleaning is required.

SUMMARY OF THE INVENTION

Surprisingly, it has now been found that an aqueous lubricant solution, based in part on a particular group of fatty alkyl amines as further defined below, exhibits substantially improved clouding behavior, particularly in water with a high proportion of polyvalent anions, as well as very favorable gliding action.

In accordance with the present invention, there is provided an aqueous lubricant solution comprising a lubricating amount of a fatty alkyl amine in an aqueous base, the fatty alkyl amine comprising at least one compound of the formulas (I) or (II):

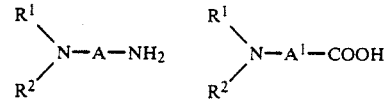

(I) (II)

wherein $R^1$ is a saturated or unsaturated, branched or linear alkyl group having 8–22 carbon atoms, $R^2$ is hydrogen, an alkyl group or hydroxyalkyl group having 1–4 carbon atoms, or —A—$NH_2$, A is a linear or branched alkylene group having 1–8 carbon atoms, and $A^1$ is a linear or branched alkylene group having 2–4 carbon atoms; and the lubricant solution has a pH of from about 5 to about 8.

As further described below, the aqueous lubricant solution may also contain other additives as needed, for example, one or more of other fatty alkyl amines, acids to adjust the solution pH, dispersing agents and dissolving agents.

The aqueous lubricant solutions in accordance with the present invention find particular use in bottle conveying processes, in which a conveyor belt is lubricated with at least one lubricating agent comprising these aqueous lubricant solutions.

When used as belt lubricants, the aqueous lubricant solutions according to the present invention display very favorable lubricating properties and, because of the presence of the fatty alkyl amines of the formulas (I) and (II), also display improved clouding behavior as compared with other prior art lubricating solutions, such as those of previously incorporated U.S. Pat. No. 4,839,067 which are based on neutralized primary fatty alkyl monoamines.

Additionally, in the stated pH range the presence of a sequestering agent is not required because of this improved clouding behavior, and cleaning may take place at less frequent intervals on account of reduced forming of precipitate.

Still further, the aqueous lubricant solutions according to the present invention possess low foaming tendencies and good antimicrobial properties.

The aqueous lubricant solutions according to the invention are preferably prepared as a concentrate and diluted to its end concentration prior to use. As a result of their improved clouding behavior, dilution of these aqueous lubricant solutions is possible with water having a high proportion of polyvalent anions.

These and other features and advantages of the present invention will be more readily understood by those skilled in the art from a reading of the following detailed description.

DETAILED DESCRIPTION OF THE PREFERRED EMBODIMENTS

As mentioned above, the aqueous lubricant solutions according to the present invention contain a lubricating amount of a fatty alkyl amine of the formulas (I) or (II):

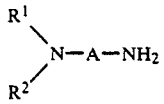

(I)

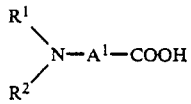

(II)

wherein $R^1$ is a saturated or unsaturated, branched or linear alkyl group having 8–22 carbon atoms, $R^2$ is hydrogen, an alkyl group or hydroxyalkyl group having 1–4 atoms, or —A—$NH_2$, A is a linear or branched alkylene group having 1–8 carbon atoms, and $A^1$ is a linear or branched alkylene group having 2–4 carbon atoms.

Preferred are compounds in which $R^1$ is a saturated or unsaturated, branched or linear alkyl group having 12–18 carbon atoms; $R^2$ is hydrogen or —A—$NH_2$; and A and $A^1$ are saturated alkylene groups having 2–4 carbon atoms. Especially preferred are those compounds in which $R^1$ has the above-mentioned meaning, $R^2$ is hydrogen, and A and $A^1$ are propylene groups.

As examples of such fatty alkyl amines may be mentioned N-coco-1,3-diaminopropane, N-tallow-1,3-diaminopropane, N-oleyl-1,3-diaminopropane, N-lauryl-1,3-diaminopropane and N-coco-beta-amino butyric acid.

Particularly preferred for use in the aqueous lubricant solutions according to the present invention are the aforedescribed fatty alkyl amines of the formula (I) due in part to their antimicrobial properties.

In preferred embodiments, the aqueous lubricant solutions comprise from about 0.001% to about 1% by weight, preferably from about 0.005% to about 0.1% by weight, based on the weight of the aqueous lubricant solution, of fatty alkyl amines of the formulas (I) and (II).

In addition to the above-mentioned fatty alkyl amines, the aqueous lubricant solutions according to the present invention may also contain a fatty alkyl monoamine of the formula (III):

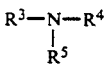

(III)

wherein $R^3$ is a saturated or unsaturated, branched or linear alkyl group having 8–22 carbon atoms, $R^4$ is hydrogen, an alkyl group or hydroxyalkyl group having 1–4 carbon atoms, and $R^5$ is equal to $R^3$ or $R^4$.

As examples of such fatty alkyl monoamines may be mentioned hexadecyl dimethyl amine, octadecyl dimethyl amine, coco dimethyl amine, tallow dimethyl amine, oleyl dimethyl amine, dicoco methyl amine, ditallow methyl amine, oleyl amine, coco amine and lauryl amine.

In preferred embodiments, the aqueous lubricant solution comprises from 0 to about 1% by weight, preferably from 0 to about 0.5% by weight, and especially from 0 to about 0.1% by weight, based upon the weight of the aqueous lubricant solution, of fatty alkyl monoamines of the formula (III).

The aqueous lubricant solutions may contain mixtures of the above-described fatty alkyl amines having alkyl groups of different chain lengths, as well as mixtures comprising a proportion of unsaturated fatty alkyl amines of at least 50%, based on the total amount of fatty alkyl amines.

To improve the solubility of the fatty alkyl amines, acids which form pH-neutral salts with the amines may be added to the lubricant composition, organic acids being given preference over inorganic acids because of their more favorable solubility.

Although in principle use may be made of all organic acids, preference is given to acetic acid, formic acid and gluconic acid. The acids are used in amounts sufficient to set the pH of the solution at from about 5 to about 8, preferably from about 6 to about 8, generally requiring amounts ranging from about 0.001% to about 1% by weight, preferably from about 0.005% to about 0.1% by weight, based upon the weight of the aqueous lubricant solution.

As further constituents of the lubricant solution may be mentioned, for example, solubilizer and dispersing agents.

Solubilizer are generally used in amounts ranging from 0 to about 20% by weight, preferably from 0 to about 10% by weight, based upon the weight of the aqueous, lubricant solution. As particular examples of suitable solubilizer may be mentioned isopropanol, ethanol and glycols such as ethylene glycol, propylene glycol and hexylene glycol.

Dispersing agents may be added to the lubricant solution generally in amounts ranging from 0 to about 1% by weight, preferably from 0 to about 0.5% by weight, and especially from 0 to about 0.1% by weight, based upon the weight of the aqueous lubricant solution.

As examples of suitable dispersing agents may be mentioned triethanolamine, and alkoxylated fatty alkyl monoamines and diamines of the formulas (IV) and (V):

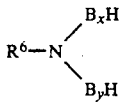

(IV)

and

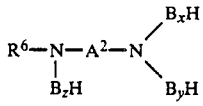

(V)

wherein $R^6$ is a linear or branched, saturated or unsaturated alkyl group having 8–22 carbon atoms, $A^2$ is a linear or branched alkylene group having 1–8 carbon atoms, B represents ethoxy or propoxy groups, which may be the same or different in each of the above uses, and the sum of x and y and, optionally, z is a number in the range of 2 to 200.

As examples of such compounds may be mentioned coco bis(2-hydroxyethyl)amine, polyoxyethylene(5-)coco amine, polyoxyethylene(15)coco amine, tallow bis(2-hydroxyethyl)amine, polyoxyethylene(5)tallow amine, tallow/oleyl bis(2-hydroxyethyl)amine, oleyl bis(2-hydroxyethyl)amine, polyoxyethylene(5)oleyl amine, polyoxyethylene(15)oleyl amine, tallow bis(2-hydroxyethyl)amine (hydrogenated), polyoxyethylene(5)tallow amine (hydrogenated), polyoxyethylene(15)tallow amine (hydrogenated), polyoxyethylene(50)tallow amine (hydrogenated), N,N',N'-tris(2-hydroxyethyl)N-tallow-1,3-diaminopropane, N,N',N'-polyoxyethylene(10)-N-tallow-1,3-diaminopropane, N,N',N'-polyoxyethylene(15)-N-tallow-1,3-diaminopropane, and polyoxyethylene(15)tallow amine.

The aqueous lubricant solutions according to the present invention are preferably prepared as concentrates comprising from about 1% to about 30% by weight, based upon the weight of the concentrate, of the amines of the formulas (I) and (II). Additionally, such concentrates may comprise from 0 to about 25% by weight of the amines of the formula (III), a sufficient amount of acid to result in pH upon dilution of from about 5 to about 8 (preferably from about 1% to about 30% by weight), from 0 to about 15% by weight of the solubilizer and from 0 to about 50% by weight of the solubilizer. The remainder of the concentrate generally comprises an aqueous base (water).

To prepare the lubricant solutions according to the invention the concentrates are diluted in an aqueous base to their end concentration prior to use. Dilution is usually carried out with tap water, but may also be carried out with soft water as well as with any water-miscible liquid, such as ethanol, isopropanol, and glycols, or with mixtures of such liquids with water.

The aqueous lubricant solutions in accordance with the present invention, as mentioned above, find particular use in bottle conveying processes, in which a conveyor belt is lubricated with a lubricating amount of at least one lubricating agent comprising these aqueous lubricant solutions. Such bottle conveying processes and apparatus utilized therein are well-known in the art, as exemplified by the disclosure of previously incorporated U.S. Pat. No. 4,839,067, and need not be discussed further herein.

Advantages of the aqueous lubricant solutions according to the invention are demonstrated in the following Examples, which are offered by way of illustration and not limitation thereof.

EXAMPLES

Example 1

Concentrates of the following compositions were prepared (all amounts are in per cent by weight):

TABLE I

| Constituents | Concentrate Compositions A | B | C | D | E | F | G |
|---|---|---|---|---|---|---|---|
| Water | 71.0 | 70.5 | 67.5 | 66.5 | 70.5 | 66.2 | 71.0 |
| Acetic acid (60%) | 5 | 5 | 8 | 5 | 5 | 9.3 | 5 |
| Coco amine | 5.5 | — | — | — | 6 | — | 5.5 |
| Oleyl amine | — | — | — | — | — | — | 6.5 |
| N-coco-1,3-diaminopropane | — | 6 | 6 | 12 | — | — | — |

TABLE I-continued

| Constituents | Concentrate Compositions A | B | C | D | E | F | G |
|---|---|---|---|---|---|---|---|
| N-oleyl-1,3-diaminopropane | 6.5 | 6 | 6 | 6 | 6 | — | — |
| N-coco-beta-amino butyric acid | — | — | — | — | — | 12 | — |
| Polyoxyethylene-(15)-oleyl amine | 2 | 2 | 2 | — | 2 | 2 | 2 |
| Triethanolamine | 1.5 | 1.5 | 1.5 | 1.5 | 1.5 | 1.5 | 1.5 |
| Isopropanol | 8.5 | 9 | 9 | 9 | 9 | 9 | 8.5 |

As comparative product based upon a primary fatty alkyl monoamine was used a composition according to Example 1 of previously incorporated U.S. Pat. No. 4,839,067 (Composition G).

Example 2

In a flask 0.6 g of the compositions of Example 1 and 200 ml water were mixed with stirring to prepare solutions with which the clouding behavior and gliding action were tested as follows:

(a) For testing the clouding behavior, tap water having a degree of hardness of 4°–8° dH, and also soft water to which were added 500 ppm of chloride ions and 500 ppm of sulphate ions and which had a degree of hardness of 20° dH, were used as diluting water for the preparation of solutions for use from the concentrates.

The clouding that occurred was assessed visually at various time intervals and comparatively qualified by the assignment of a number in the range of 1 to 5, with the solution with the slightest clouding being rated 1 and that with the greatest clouding being rated 5.

The clouding after 6 hours of the soft water/chloride-sulphate ion solution (20° dH) was also assessed by means of a haze meter (Type UKM 1d of the firm Radiometer, Copenhagen), with the results expressed in EBC (European Brewery Convention) units.

(b) For testing of the gliding action, 0.3 ml of the lubricant solutions prepared with tap water (4°–8° dH) were applied to a glass disc over which a metal disc attached to an electric motor was rotated, the gliding action being determined by means of the constancy of the rotary motion and the change in the power consumption of the electric motor driving the metal disc. The metal disc had a surface area of 7 $cm^2$ and was pressed onto the glass plate with a pressure of about 500 $g/cm^2$.

The experimentally obtained data for the various compositions was evaluated, with the experimental value of the comparative solution G arbitrarily being rated 100 and the remaining lubricant solution values being expressed in relation thereto. The results of the experiments 2 (a) and (b) are summarized below in Table II.

TABLE 2

| Composition | pH | Clouding behavior and gliding action: Clouding behavior immediately upon addition, synthetic water | Clouding behavior immediately upon addition, tap water | Clouding behavior after 6 hours, synthetic water | Clouding behavior after 6 hours, tap water | Clouding Behavior after 6 hours (Measured), synthetic water water | Clouding behavior after 24 hours, synthetic water | Clouding behavior after 24 hours, tap water | gliding action |
|---|---|---|---|---|---|---|---|---|---|
| A | 7.25 | 2 | 2 | 2 | 2 | 8 | 2 | 2 | 100 |
| B | 7.65 | 3 | 3 | 3 | 3 | 24 | 2 | 2 | 100 |
| C | 6.8 | 1 | 1 | 1 | 1 | <0.5 | 1 | 1 | 100 |
| D | 7.9 | 2 | 2 | 2 | 2 | 8 | 3 | 3 | 100 |
| E | 7.65 | 4 | 4 | 4 | 4 | 68 | 4 | 4 | 110 |
| F | 5.1 | 1 | 1 | 1 | 1 | <0.5 | 1 | 1 | 100 |

TABLE 2-continued

| | | Clouding behavior and gliding action | | | | | | | |
|---|---|---|---|---|---|---|---|---|---|
| | | Clouding behavior immediately upon addition | | Clouding behavior after 6 hours | | Clouding Behavior after 6 hours (Measured) | Clouding behavior after 24 hours | | |
| Composition | pH | synthetic water | tap water | synthetic water | tap water | synthetic water water | synthetic water | tap water | gliding action |
| G | 7.2 | 5 | 5 | 5 | 5 | 128 | 5[1] | 5[1] | 100 |

[1]conglomerate forming

We claim:

1. An aqueous lubricant solution comprising consisting essentially of a lubricating amount of (a) a fatty alkyl amine in an aqueous base, the fatty alkyl amine comprising at least one compound of the formula (I) or (II):

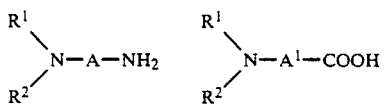

(I) (II)

wherein $R^1$ is a saturated or unsaturated, branched or linear alkyl group having 8–22 carbon atoms, $R^2$ is hydrogen, an alkyl group or hydroxyalkyl group having 1–4 carbon atoms, or —A—$NH_2$, A is a linear or branched alkylene group having 1–8 carbon atoms, and $A^1$ is a linear or branched alkylene group having 2–4 carbon atoms; and the lubricant solution has a pH of from about 5 to about 8.

2. The aqueous lubricant solution according to claim 1, wherein $R^1$ is a saturated or unsaturated, branched or linear alkyl group having 12–18 carbon atoms; $R^2$ is hydrogen or —A—$NH_2$; and A and $A^1$ are a saturated alkylene group having 2–4 carbon atoms.

3. The aqueous lubricant solution according to claim 2, wherein $R^2$ is hydrogen, and A and $A^1$ are a propylene group.

4. The aqueous lubricant solution according to claim 1, wherein the aqueous lubricant solution has a pH of from about 6 to about 8.

5. The aqueous lubricant solution according to claim 1, consisting essentially of from about 0.001% to about 1% by weight, based on the weight of the aqueous lubricant solution, of the fatty alkyl amines of the formulas (I) and (II).

6. The aqueous lubricant solution according to claim 1, wherein the fatty alkyl amine comprises at least one fatty alkyl amine of the formula (I).

7. The aqueous lubricant solution according to claim 1, further consisting essentially of one or more of:

b) a fatty alkyl monoamine of the formula (III):

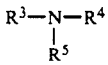

(III)

wherein $R^3$ is a saturated or unsaturated, branched or linear alkyl group having 8–22 carbon atoms, $R^4$ is hydrogen, an alkyl group or hydroxyalkyl group having 1–4 carbon atoms, and $R^5$ is equal to $R^3$ or $R^4$;

(c) an acid in an amount sufficient to set the pH of the lubricant solution at from about 5 to about 8;

(d) a dispersing agent; and (e) solubilizer.

8. The aqueous lubricant solution according to claim 7, further consisting essentially of:

(b) from 0 to about 1% by weight of the fatty alkyl monoamine of the formula (III);

(c) from 0.001 to about 1% by weight of the acid;

(d) from 0 to about 1% by weight of the dispersing agent; and (e) from 0 to about 20% by weight of the solubilizer; wherein % by weight is based upon the weight of the aqueous lubricant solution.

9. The aqueous lubricant solution according to claim 8, further consisting essentially of:

(a) from about 0.005% to about 0.1% by weight of the fatty alkyl amines of the formulas (I) and (II), (b) from 0 to about 0.5% by weight of the fatty alkyl monoamine of the formula (III);

(c) from 0.005% to about 0.1% by weight of the acid;

(d) from 0 to about 0.5% by weight of the dispersing agent; and (e) from 0 to about 10% by weight of the solubilizer.

10. An aqueous lubricant solution concentrate, consisting essentially of (a) from about 1% to about 30% by weight, based upon the weight of the concentrate, of at least one fatty alkyl amine of the formulas (I) or (II):

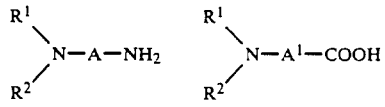

(I) (II)

wherein $R^1$ is a saturated or unsaturated, branched or linear alkyl group having 8–22 carbon atoms, $R^2$ is hydrogen, an alkyl group or hydroxyalkyl group having 1–4 atoms, or —A—$NH_2$, A is a linear or branched alkylene group having 1–8 carbon atoms, and $A^1$ is a linear or branched alkylene group having 2–4 carbon atoms.

11. The concentrate according to claim 10, further consisting essentially of:

(b) up to about 25% by weight of a fatty alkyl monoamine of the formula (III):

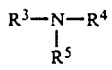

(III)

wherein $R^3$ is a saturated or unsaturated, branched or linear alkyl group having 8–22 carbon atoms, $R^4$ is hydrogen, an alkyl group or hydroxyalkyl group having 1–4 carbon atoms, and $R^5$ is equal to $R^3$ or $R^4$.

12. A process for lubricating a bottle conveyor with a lubricating amount of an aqueous lubricant solution consisting essentially of a lubricating amount of (a) a fatty alkyl amine in an aqueous base, the fatty alkyl amine comprising at least one compound of the formulas (I) or (II):

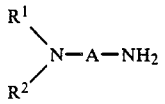

(I)

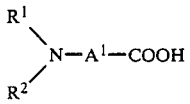

(II)

wherein $R^1$ is a saturated or unsaturated, branched or linear alkyl group having 8–22 carbon atoms, $R^2$ is a hydrogen, an alkyl group or hydroxyalkyl group having 1–4 atoms, or $—A—NH_2$, A is a linear or branched alkylene group having 1–8 carbon atoms, and $A^1$ is a linear or branched alkylene group having 2–4 carbon atoms.

13. The process according to claim 12, wherein the aqueous lubricant solution further consisting essentially of one or more of:

(b) a fatty alkyl monoamine of the formula (III):

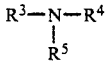

(III)

wherein $R^3$ is a saturated or unsaturated, branched or linear alkyl group having 8–22 carbon atoms, $R^4$ is hydrogen, an alkyl group or hydroxyalkyl group having 1–4 carbon atoms, and $R^5$ is equal to $R^3$ or $R^4$.

* * * * *